US005430913A

United States Patent [19]

Kotschy

[11] Patent Number: 5,430,913

[45] Date of Patent: Jul. 11, 1995

[54] KEYBOARD INSTRUMENT FOR THE NATURAL TONE SYSTEM

[76] Inventor: Johannes Kotschy, Dachsteinstrasse 2, D-8235 Piding, Germany

[21] Appl. No.: 942,623

[22] Filed: Sep. 9, 1992

[30] Foreign Application Priority Data

Sep. 10, 1991 [DE] Germany ..... 41 30 043.2

[51] Int. Cl.[6] ..... G10C 3/12

[52] U.S. Cl. ..... 84/423 R; 84/451

[58] Field of Search ..... 84/423 R, 451, 657, 84/DIG. 18

[56] References Cited

U.S. PATENT DOCUMENTS

| | | | |
|---|---|---|---|
| 2,232,600 | 2/1941 | Fickenscher | 84/451 |
| 3,012,460 | 12/1961 | Wilson | 84/423 |
| 4,480,519 | 11/1984 | Allen | 84/451 X |
| 4,628,792 | 12/1986 | Keast | 84/451 |

FOREIGN PATENT DOCUMENTS

| | | |
|---|---|---|
| 290056 | 12/1913 | Germany . |
| 3810321A1 | 10/1989 | Germany . |
| WO90/16058 | 12/1990 | WIPO . |

*Primary Examiner*—M. L. Gellmer
*Assistant Examiner*—P. Stanzione
*Attorney, Agent, or Firm*—Jones & Askew

[57] ABSTRACT

A keyboard instrument for the natural tone system with at least one keyboard whose keys are assigned to the overtones in a predetermined sequence. According to the invention, the keyboard is optimally adapted to the conditions of the natural tone system by the fact that 16 keys are provided per octave which are arranged and constructed in such a way that the natural tones can be played in sequence on three playing levels. One peculiarity of the invention consists of the boxed arrangement of the keys on the three playing levels, whereby only the "harmonic keys" are arranged on the frontal playing level, the "melodic keys" and the tapered "harmonic keys" are arranged on the central playing level, and that the tapered section of the "melodic keys," a further tapered section of the "harmonic keys" and the "chromatic keys" are arranged on the rear playing level. The adjacent key sections on each playing level are equally wide.

43 Claims, 3 Drawing Sheets

KEYBOARD INSTRUMENT FOR THE NATURAL TONE SYSTEM

BACKGROUND OF THE INVENTION

The invention pertains to a keyboard instrument for the natural tone system.

While conventional musical compositions are primarily based on the tempered tone system, microtonal compositions are predominately based on the so-called natural tone system. The term natural tone system or natural tone series represents the succession of overtones that are defined as an integral multiple of the fundamental frequency of a tone:

$$f(n)=f(o)\times n, \text{ with } n=1, 2, 3 \ldots$$

In this formula n is also designated as the natural tone number.

As compared to the overtone series, the fundamental tone in a natural tone series is already designated as the first natural tone. It is characteristic for the natural tone series or the natural tone system that an octave shift is always produced by a power of 2.

It is basically possible to form arbitrary natural tone series on any desired fundamental frequency. To compose sensibly and perform using the natural tone system, it is necessary however to make a selection. This selection suggests that only the tones of a natural tone series defined by a certain fundamental frequency and their octaves are permitted as fundamentals. This results in natural tone series selected with reference to a so-called modulation factor m in accordance with the natural tone number as follows:

$$f(n,m)=f(o)\times n\times m, \text{ with } n,m=1,2,3 \ldots$$

The smaller the modulation factor, the larger the number of tones which the selected series has in common with the original natural tone series.

The invention is based for practical reasons on the aforementioned selected natural tone series. However, the invention is not limited to these selected natural tone series.

All types of conventional instruments, which also include keyboard instruments, are basically suitable for microtonal music. One problem with the performance of microtonally composed music on keyboard instruments can be seen in the fact that keyboard instruments are designed for the tempered tone system outlined in the subclaims.

While the aforementioned keyboard instruments for the natural tone system thus far used conventional keyboards or personal computer keyboards designed for the tempered tone system consists of, the invention suggests that the number of keys per octave be increased to 16, and that their arrangement be designed such that the natural tones 4–7 (24), 8–15 (25,34) and 16–31 (26,35,40,41) are played in series on three playing levels.

The invention thus provides a special new keyboard for the pure intervals contained in the natural tone scale which not only meets the requirements of the natural tone series, but is also compatible with the performance technique already learned for keyboard instruments, so that playing on the keyboard instrument according to the invention can also be easily learned by persons accustomed to conventional keyboard instruments.

The ability to play the keyboard instrument according to the invention on three playing levels is attained by three different forms of keys, namely by "harmonic keys" that tapered twice from the front toward the rear, by "melodic keys" tapered only once, and by "chromatic keys" with uniform width. These keys are arranged relative to each other in such a way that only the front sections of the "harmonic keys" with a maximum width are located adjacent to each other in the front field or front playing level. In the central field or central playing level, the sections of the "harmonic keys" that correspond with the first tapering adjoin the front sections of the melodic keys with the same width, and are thus represented alternately with the harmonic keys in the central field. The rear field or rear playing level is formed by the sections of the "harmonic keys" that are tapered for the second time, the tapered sections of the "melodic keys" and the "chromatic keys" with uniform width, namely in the regular series: "harmonic key," "melodic key" and "chromatic key." It is essential that the adjacent key sections are equally wide and equally long or deep within each playing level.

In other words, the structure of the keyboard of the keyboard instrument according to the invention provides at least three differently shaped types of keys in order to realize the different playing levels or key fields, namely a first type of key which extends over the entire depth of the keyboard and has a given maximum width in the frontal section, whereby the maximum width can, for example, correspond to the width of the keys on conventional keyboards. Within the area of the harmonic tones (n,m=4,5,6,7) this type of key can continuously have the aforementioned maximum width. This type of key has a central section of reduced width, preferably half the maximum width, at least within the area of the melodic tones (m,n=8 to 15). A second type of key which is recessed against the first type of key is arranged within this tone area, whereby the recessed keys have their largest width in the central area of the first mentioned type of key, and their width is strongly reduced in the rear section of the field of the chromatic tones (n,m=16 to 32) located adjacent to the melodic tones, whereby the section with strongly reduced width lies adjacent to a correspondingly smaller section of the first mentioned type of key as well as a third type of key which is constructed similar, preferably equally narrow.

At least within the area of chromatic tones, the first type of key thus comprises keys with a frontal area of maximum width, a central area of reduced width, preferably half the maximum width, and a rear section with a further reduced width that preferably corresponds to a quarter of the maximum width. The second type of key has two differently wide areas at least within the area of the chromatic tones, namely a frontal width that preferably corresponds to half the maximum width, and a rear section of reduced width that preferably corresponds to a quarter of the maximum width. As compared to these two types of keys, the third type of key which is exclusively arranged within the area of chromatic tones preferably has one single width, namely a width that corresponds to a quarter of the maximum width.

Finally, keys for the microchromatic tones (n,m=33 to 64) can adjoin the area of chromatic tones, that is, preferably arranged to the right of the keys that correspond to the chromatic tones. These keys which preferably have a width which corresponds to an eighth of the maximum width are preferably constructed as sensors and lie in a preferred doubled example of the aforementioned keyboard structure within the area of the recessed sections of the keys assigned to the harmonic tones.

The keys of the keyboard according to the invention thus provide the possibility of playing natural tones in series. All keys preferably have the same height; this means that no key protrudes over another one, so that glissando playing can be performed.

The wedge shape of the keys suggested according to the invention in the tapered area ensures an even distribution of the playing surfaces and in turn provides substantial advantages in regard to the performance technique.

While the keyboard of the keyboard instrument according to the invention is preferably a manual, which means a keyboard that is played manually, it is basically also possible to utilize this keyboard with keys activated by the feet as is customary with an organ.

While a scale change can be executed by activation of a push button in the conventional manner (see keyboards of electronic keyboard instruments), the keyboard instrument according to the invention utilizes a second manual which is structured similar to the first manual and into which the new fundamental can be entered. Both manuals can be switched parallel with the aid of a special coupler.

The additional manual furthermore makes it possible not only to quickly change the scales, but also to arbitrarily combine the manuals during simultaneous play, which in turn provides a substantial expansion for the playing of natural tones. It is, for example, possible to not only combine two overtone series with m=1,3,5,7,9,11,13,15, in any desired manner, but also to combine overtone and undertone series with each other by switching one manual to the undertone series; thus the following combinations are possible:

| | | | |
|---|---|---|---|
| 1) | I: Overtone series<br>II: Undertone series | 3) | I: Undertone series<br>II: Overtone series |
| 2) | I: Overtone series<br>II: Overtone series | 4) | I: Undertone series<br>II: Undertone series |

Even couplings between the manuals are possible. This means that altogether 140 combination possibilities can be realized.

An octave shift of the tones on one manual of the keyboard instrument according to the invention is preferably made possible by depressing a special key. A reversal of the fundamentals can be particularly easily realized, whereby the fundamental is, for example, octave shift on one of the manuals (for example the lower manual). One adjusting wheel per manual is furthermore provided in order to quickly shift the instrument. This means that the tonal range of the instrument can be enlarged without any problems, whereby the distances can be increased by octave shifts if undesirably dense sound combinations of different scales occur.

Surprising sound effects can be obtained by the addition of pre-programmable mixtures. By entering 3-3-2, the tone played is supplemented by overtones within the predetermined intervals; the following sound combinations can be played:

| | | | | |
|---|---|---|---|---|
| tone played | 8 | 9 | 11 | 10 |
| | 11 | 12 | 14 | 13 |
| | 14 total sound | 15 | 17 | 16 |

-continued

| | | | |
|---|---|---|---|
| 16 | 17 | 19 | 18 |

Mixtures of both manuals can furthermore be combined or coupled with each other.

| | | | | |
|---|---|---|---|---|
| | | 16 | | |
| | 8 | 22 | | |
| 1st manual | 11 | 24 | 8 | 2nd manual |
| m = 2 | 14 | 28 | 10 | m = 3 |
| | 18 | 30 | 13 | |
| | | 36 | 16 | |
| | | 39 | | |
| | | 48 | | |
| | | total sound | | |

Undertone scales are thus far used relatively little in compositions because of the lack of suitable keyboard instruments. The keyboard instrument according to the invention allows a practical realization of undertone scales whose melodic tone series can be recognized, although they are ficticious when played polyphonically. Since the same keys can basically be utilized for the undertone scales, all that is really necessary is to alter the colors of the keys. While the harmonic keys third and seventh are for example, normally blue and green, the lower tone series can be indicated optically, for example, by the fact that the two aforementioned keys remain blue, while the seventh of the overtone or undertone series is underlaid with yellow which can, for example, be done by an appropriate illumination of the keys.

The invention is described in detail in the following with the aid of the figures. They show:

DESCRIPTION OF THE PREFERRED EMBODIMENT

Figure 1:
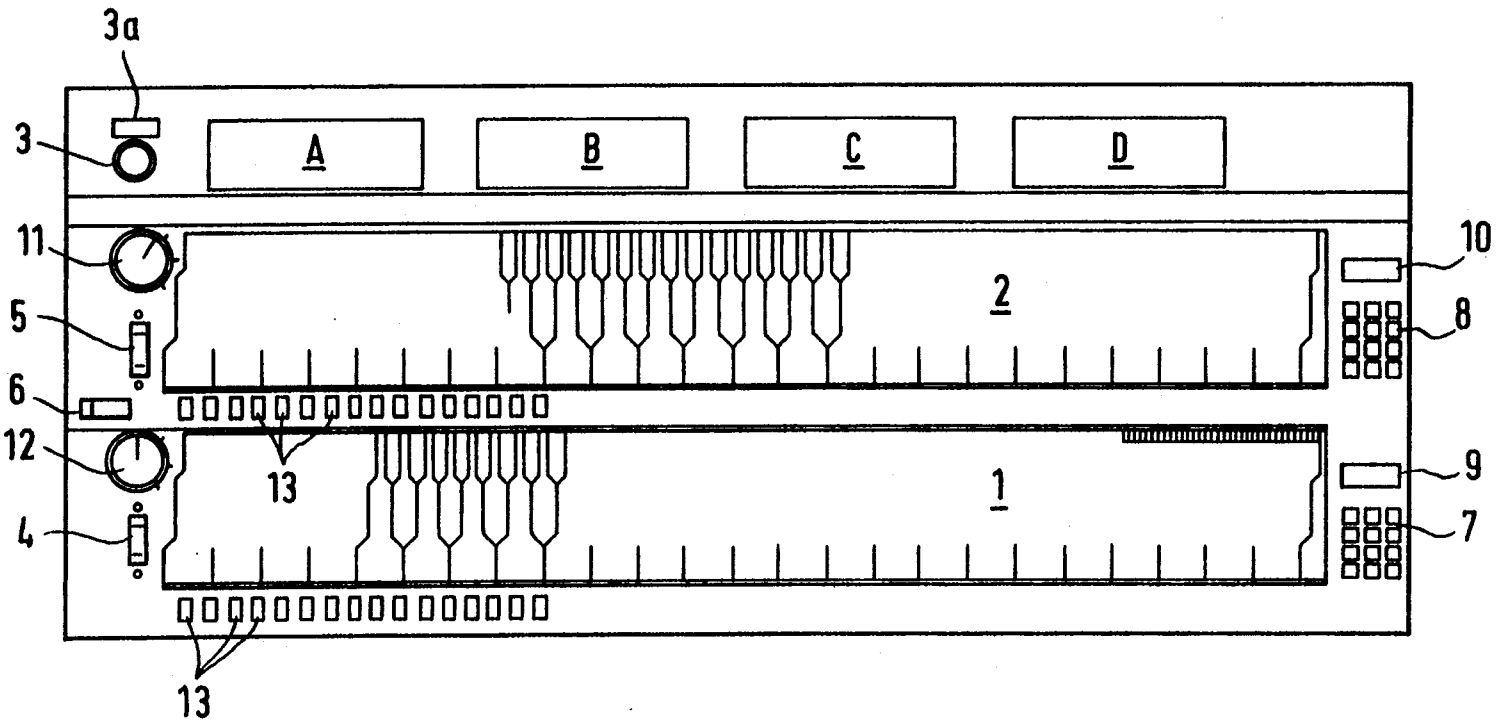
FIG. 1 a two-manual example of a keyboard instrument according to the invention.

The keyboard illustrated in FIG. 1 comprises a lower manual (1) as well as an upper manual (2), a collective adjusting wheel (3) for the fundamental frequency $f_o$ of both manuals with a corresponding display (3*a*), a flip switch (4) in the left area of the lower manual (1) as well as a flip switch (5) in the left area of the upper manual (2) in order to switch the corresponding manual to the overtone or undertone series, and a coupling switch (6) which is arranged between the upper and the lower manual and makes a coupling of both manuals possible. For octave shifts one adjusting wheel (11 or 12) is provided per manual (1,2). At the right end of each manual (1 and 2), equally structured keyboard fields (7 or 8) are provided in order to preset certain mixtures that are displayed on display units (9 and 10) arranged above the keyboard fields (7 and 8). The key fields in the example shown in the figure are designed as a ten-key keyboard.

Modulation keys (13) are arranged below the keys of the upper and lower manual (1 and 2), and the numbering of the modulation keys (see also FIG. 2) corresponds to the modulation factor m. Four not closer specified fields (A, B, C, D) for programs, samplers, sound synthesis and so forth are arranged above the upper manual (2) within a framed area.

Figure 2:
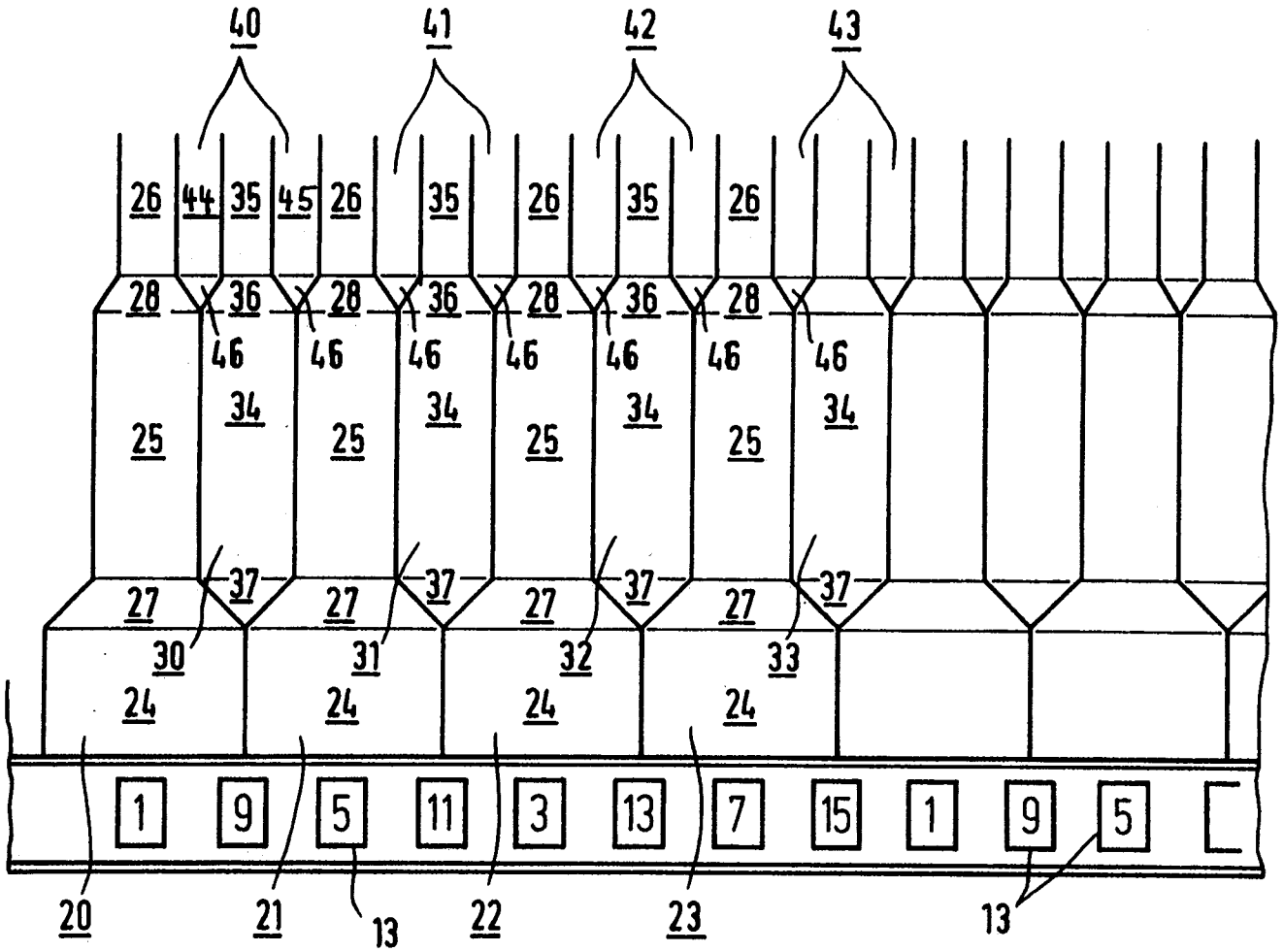
FIG. 2 a detail of the keyboard on the keyboard instrument illustrated in FIG. 1 in the area of the keys assigned to the chromatic tones.

FIG. 2 shows a detail of, for example, the lower manual (1) in the area of the keys assigned to the chromatic natural tones in order to illustrate the shapes of the keys.

FIG. 2 furthermore shows that three different types of keys are utilized, namely the keys (20–23) which extend over the entire depth of the corresponding manual, recessed keys (30–33) with smaller dimensions than the first mentioned keys, as well as even smaller keys (40–43) arranged in the rear area of the manual.

The large keys (20–23) comprise a frontal section (24) with a given maximum width, a central section (25) with half the maximum key width, and a rear section (26) with a quarter of the maximum width. Tapered areas (27 and 28) with slanted lateral edges are arranged between the three aforementioned areas (24–26).

The next smaller keys (30–33) extend with their frontal section (34) between two adjacent central sections (25) of the large keys (20–23) and have a recessed or rear section (35) that borders two adjacent keys (40,40; 41,41; 42,42) of the smallest type. The medium sized keys (30 to 33) have a frontal pointed section (37) that borders the slanted edges of the tapered sections (27) of keys (20 to 23), as well as a rear narrow section (36) that borders the frontal pointed sections (46) of the rear keys (40 to 43). The medium sized keys (30 to 33) have the same width in the frontal section (34) as the adjacent central sections of keys (20 to 23) with whose sections they are arranged alternately. The rear keys (40 to 43) as well as the rear key section (35) have the same width as the rear section (26) of the large keys.

The following series results in the rear key field: large key (section 26)—rear small key 40 (41, 42, 43)—medium sized key (rear section 35).

Figure 3:
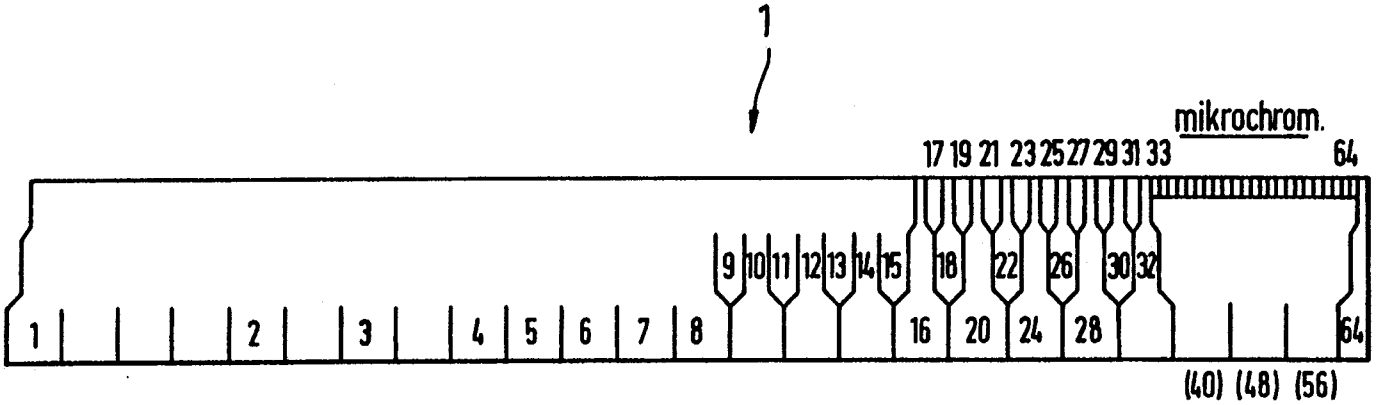
FIG. 3 a schematic representation of a manual illustrated in FIG. 1 in order to explain the playing sequence while reproducing a particular natural tone series.

FIG. 3 illustrates how an overtone series or a natural tone series is played on the keyboard instrument in the natural tone system, namely in the series of the key numbers (1 to 64), in accordance with the natural tone numbers.

FIG. 3 furthermore illustrates that harmonic tones can be played in the left field with the key numbers (4 to 7), that the melody-forming tones can be played in the central field with the key numbers (8 to 15), and that the chromatic tones can be played in the upper field with the key numbers (16 to 31). In the last octave the key numbers (33 to 64) which are assigned to the microchromatic tones of the same numbers are arranged adjacent to the aforementioned keys.

16 tones can be played in each octave, which does not counteract the playing of music in the natural tone system since the natural tone system can also be expanded downward in an unlimited manner. If one plays, for example, the chromatic tones (16 to 32) in the lowest octave, then the fundamental must be visualized four octaves lower, which means outside the instrument offset towards the left in FIG. 1 and FIG. 3.

The previously described keyboard or the previously described manuals are specially adapted to the playing of natural tones by the fact that the key widths and arrangements meet with the requirements of the natural tone series, which means that the intervals become constantly smaller, and the boxed arrangement of the keys in particular in the area of the chromatic tones represents a technological peculiarity that enhances the ability to play the keyboard instrument.

I claim:

1. A keyboard instrument for the natural tone system in which natural tones of a frequency f(n,m) are structured on a given fundamental of a frequency f(0) as follows:

$f(n,m)=f(0)\times n\times m$ (n,m=1,2,3, . . . 64 . . . ), whereby n represents the natural tone number and m represents a modulation factor, comprising at least one keyboard having keys that are assigned to the natural tones in a predetermined sequence characterized by the fact that sixteen keys are provided per octave, and that the keys are arranged and constructed in such a way that natural tones 4 to 7 (24), are assigned to a first contiguous sequence of keys at a first playing level, natural tones 8 to 15 (25,34) are assigned to a second contiguous sequence of keys at a second playing level, and natural tones 16 to 31 (26,35,40,41) are assigned to a third contiguous sequence of keys at a third playing level.

2. A keyboard instrument according to claim 1, characterized by the fact that at least some of said keys have sections of different widths.

3. A keyboard instrument according to claim 1 characterized by the fact that the keyboard is divided into several fields within which at least predetermined adjacent areas of the keys are equally wide.

4. Keyboard instrument according to claim 3, characterized by the fact that the longitudinal extent of the keys (20 to 23; 30 to 33; 40 to 43) corresponding to each field is divided into sections of various widths across the keyboard (1,2).

5. Keyboard instrument according to claim 4, characterized by the fact that the keyboard (1, 2) has the following structure:

the keys assigned to the harmonic tones (n=. . . 4, 5, 6, 7 . . . ) have a predetermined maximum width at least in the frontal section (24), the keys assigned to the melodic tones (n=8 to 15) follow the keys assigned to the harmonic tones, whereby the keys assigned to even-numbered melodic tones (8, 10, 12, 14) have a frontal section (24) with the full maximum width and an adjacent central section (25) with reduced width, and whereby the surfaces that are not taken up by these keys in the central section are taken up by sections of the keys that are assigned to me uneven melodic tones (9, 11, . . . 15), and the keys assigned to the chromatic tones (16 to 32) follow the keys assigned to the melodic tones, whereby the chromatic keys assigned to the even-numbered chromatic tones (16, 20 . . . 32) have a front section (24) with full base width, a central section (25) with reduced width and a rear section (26) with further reduced width, and whereby the frontal sections (34) of the keys assigned to the even-numbered chromatic tones (18, 22 . . . 30) that take up the surfaces not filled out by the aforementioned keys of the central section as well as a narrower rear section (35) that lies at the stone elevation as the rear section (26) of the first mentioned keys of this field, and whereby the keys assigned to the uneven chromatic tones (17, 19 . . . 31) take up the free surfaces between the rear sections (26; 35) of both first mentioned types of keys of this field.

6. Keyboard instrument according to claim 5, characterized by the fact that the key sections (25;34) of the central vertical field area have the same width.

7. Keyboard instrument according to claim 5, characterized by the fact that the key sections (26; 44; 35; 45) of the rear vertical field area have the same width.

8. Keyboard instrument according to claim 6, characterized in the fact that the key sections (25; 34) of the central vertical field area have half the maximum width of the keys.

9. Keyboard instrument according to claim 7, characterized by the fact that they key sections (26; 44; 35; 45) of the rear field area have a quarter of the maximum key width.

10. Keyboard instrument according to claim 5, characterized by the fact that the keys in the central and rear areas extend forward in a pointed shape or the shape of a wedge.

11. Keyboard instrument according to claim 5, characterized by the fact that the keys assigned to the microchromatic tones (33 to 64 . . . ) follow the keys assigned to the chromatic tones.

12. Keyboard instrument according to claim 11, characterized by the fact that the keys assigned to the michrochromatic tones are narrower and/or shorter than the keys or key sections assigned to the chromatic tones.

13. Keyboard instrument according to claim 11, characterized by the fact that the keys assigned to the microchromatic tones are constructed as sensors.

14. Keyboard instrument according to claim 5, characterized by the fact that the keyboard (1, 2) is a manual.

15. Keyboard instrument according to claim 14, characterized by the fact that at least two cascade-like arranged manuals (1,2) are provided.

16. Keyboard instrument according to claim 15, characterized by an input device (7, 8) for predetermined overtone combinations.

17. Keyboard instrument according to claim 16, characterized by the fact that the input device (7,8) comprises a keyboard, preferably one ten-key keyboard per manual (1,2).

18. Keyboard instrument according to claim 16, characterized by the fact that the input device comprises a display (9, 10).

19. Keyboard instrument according to claim 15, characterized by an adjustment coupling device (6) for the different manuals.

20. Keyboard instrument according to claim 19, characterized by the fact that the adjustment coupling (6) comprises a flip switch.

21. Keyboard instrument according to claim 1, characterized by the fact that all keys have the same height.

22. Keyboard instrument according to claim 1, characterized by the fact that the depth of movement of the keys amounts to approximately 6 mm.

23. Keyboard instrument according to claim 1, characterized by assignment of different colors to selected keys.

24. Keyboard instrument according to claim 23, characterized by the fact that the melodic keys are white, the harmonic keys are colored, and the chromatic keys are black.

25. Keyboard instrument according to claim 1, characterized by at least one adjusting element (3) in order to select the fundamental frequency.

26. Keyboard instrument according to claim 25, characterized by the fact that the adjustment element (3) is designed for the continuous selection of the fundamental frequency.

27. Keyboard instrument according to claim 25, characterized by the fact that the adjusting element (3) comprises an adjusting wheel.

28. Keyboard instrument according to claim 1, characterized by adjusting elements (13) in order to select the modulation factor m.

29. Keyboard instrument according to claim 28, characterized by the fact that the adjusting elements (13) comprise switches assigned to the keys, primarily push button switches.

30. Keyboard instrument according to claim 1, characterized by at least one adjusting element (11, 12) for displacement of the octave.

31. Keyboard instrument according to claim 30, characterized by the fact that the adjusting element (11, 12) is designed for the continuous displacement of the octave.

32. Keyboard instrument according to claim 30 characterized by the fact that the adjusting element (11, 12) comprises an adjusting wheel.

33. Keyboard instrument according to claim 1, characterized by a switching device (4, 5) in order to switch between overtone and undertone series.

34. Keyboard instrument according to claim 33, characterized by the fact that the switching device (4,5) comprises at least one flip switch.

35. A keyboard instrument for a natural tone system in which natural tones of a frequency f(n,m) arc structured on a given fundamental of a frequency f(0) as follows:

$f(n,m)=f(0)\times n\times m$ (n,m − 1,2,3, . . . 64 . . . ), wherein n is a natural tone number and m is a selected modulation factor, comprising at least one keyboard having at least a plurality of first type keys, a plurality of second type keys, and a plurality of third type keys, disposed laterally along said keyboard, said first type keys extending forward across a first playing level, a second playing level, and a third playing level, said second type keys extending forward across said second and third playing levels, and said third type keys extending only across said third playing level;

wherein each contiguous set of sixteen keys at said third playing level spans an octave.

36. A keyboard instrument as recited in claim 35 wherein:

said first, second, and third types of keys are arranged on said keyboard so that tones for said natural tone number 4 to 7, inclusive, are sounded by a contiguous sequence of said first type keys at said first playing level.

37. A keyboard instrument as recited in claim 35 wherein:

said first, second, and third types of keys are arranged on said keyboard so that tones for said natural tone number 8 to 15, inclusive, are sounded by a contiguous sequence of said first and second type keys at said second playing level.

38. A keyboard instrument as recited in claim 35 wherein:

said first, second, and third types of keys are arranged on said keyboard so that tones for said natural tone number 16 to 31, inclusive, are sounded by a contiguous sequence of said first, second, and third type keys at said third playing level.

39. A keyboard instrument as recited in claim 38 wherein:

said first type keys have a characteristic first maximum width W, said second type keys have a characteristic second maximum width substantially equal to L/2, and said third type keys have a characteristic third maximum width substantially equal to L/4.

40. A keyboard instrument as recited in claim 35 wherein:

each of said types of keys is of substantially the same width as all other said types of keys within each of said second and third playing levels.

41. A keyboard instrument as recited in claim 35, wherein:

said first, second, and third types of keys are arranged on said keyboard so that tops of all said types of keys lie in a common plane.

42. A keyboard instrument as recited in claim 35 wherein:

each key of said first, second, and third types of keys is bilaterally symmetrical.

43. A keyboard instrument as recited in claim 35 wherein:

each of said first, second, and third types of keys are arranged on said keyboard so that keys of each respective type are distributed uniformly laterally along said keyboard.

* * * * *